US011058927B2

(12) United States Patent
Young

(10) Patent No.: US 11,058,927 B2
(45) Date of Patent: Jul. 13, 2021

(54) AUTOMATIC STRING WEAVING SYSTEM FOR STRINGED SPORTS RACQUET AND METHOD

(71) Applicant: Adaptive Integrations Technology, Inc., San Diego, CA (US)

(72) Inventor: Joseph Michael Young, Dana Point, CA (US)

(73) Assignee: ADAPTIVE INTEGRATIONS TECHNOLOGY, INC., San Diego, CA (US)

( * ) Notice: Subject to any disclaimer, the term of this patent is extended or adjusted under 35 U.S.C. 154(b) by 0 days.

(21) Appl. No.: 16/895,773

(22) Filed: Jun. 8, 2020

(65) Prior Publication Data

US 2021/0008418 A1 Jan. 14, 2021

Related U.S. Application Data

(60) Provisional application No. 62/871,625, filed on Jul. 8, 2019.

(51) Int. Cl.
*A63B 51/16* (2006.01)

(52) U.S. Cl.
CPC ..... *A63B 51/16* (2015.10)

(58) Field of Classification Search
CPC ..... A63B 51/14; A63B 51/16; A63B 51/146
See application file for complete search history.

(56) References Cited

U.S. PATENT DOCUMENTS

| | | | | |
|---|---|---|---|---|
| 2,028,663 | A | 1/1936 | Harroff | |
| 4,125,259 | A * | 11/1978 | Halbrook | A63B 51/14 473/557 |
| 4,348,024 | A * | 9/1982 | Balaban | A63B 51/14 473/556 |
| 4,452,452 | A | 6/1984 | Timmer | |
| 4,660,364 | A * | 4/1987 | Chiang | A63B 51/02 57/210 |
| 6,162,139 | A | 12/2000 | Bassili | |
| 7,862,455 | B1 | 1/2011 | Ratmiroff | |
| 10,456,633 | B1 * | 10/2019 | Polson | A63B 51/14 |
| 2011/0111893 | A1 * | 5/2011 | Severa | A63B 51/14 473/556 |
| 2020/0289899 | A1 * | 9/2020 | Williams | A63B 59/20 |
| 2021/0008418 | A1 * | 1/2021 | Young | A63B 51/16 |

FOREIGN PATENT DOCUMENTS

| | | | | |
|---|---|---|---|---|
| BE | 894058 A * | 12/1982 | | A63B 51/14 |
| CA | 3026932 A1 * | 6/2019 | | B25J 15/0019 |
| CH | 713236 A1 * | 6/2018 | | A63B 24/00 |
| DE | 4225474 C1 * | 9/1993 | | A63B 51/14 |

(Continued)

OTHER PUBLICATIONS

ISR/WO corresponding to PCT/US2020/036856, dated Sep. 25, 2020.

*Primary Examiner* — Raleigh W Chiu
(74) *Attorney, Agent, or Firm* — Procopio Cory Hargreaves and Savitch LLP

(57) ABSTRACT

An automatic string weaving system for weaving strings for a stringed sports racquet, comprising a weave assembly that the strings for the stringed sports racquet are weaved through; and an automated string feeder assembly to automatically weave the strings for the stringed sports racquet through the weave assembly.

19 Claims, 20 Drawing Sheets

(56) References Cited

FOREIGN PATENT DOCUMENTS

| | | | | | |
|---|---|---|---|---|---|
| DE | 4225473 | C1 * | 2/1994 | ..... | A63B 51/14 |
| DE | 4225473 | C1 | 2/1994 | | |
| FR | 2327803 | A1 * | 5/1977 | ..... | A63B 51/14 |
| FR | 2714840 | A1 * | 7/1995 | ..... | A63B 51/14 |
| JP | 6443894 | B1 * | 12/2018 | ..... | A63B 51/14 |
| KR | 1020190026508 | A | 3/2019 | | |
| WO | WO-2018109713 | A1 * | 6/2018 | ..... | A63B 51/14 |

* cited by examiner

AUTOMATIC STRING WEAVING SYSTEM FOR STRINGED SPORTS RACQUET AND METHOD

CROSS REFERENCE TO RELATED APPLICATION

This application claims the benefit of U.S. Provisional Patent Application No. 62/871,625, filed Jul. 8, 2019, which is incorporated by reference herein.

FIELD OF THE INVENTION

The present invention relates to stringed sports racquet stringing systems and methods.

BACKGROUND OF THE INVENTION

As shown in FIG. 1A, current methods of sports racquet stringing require the technician to weave strings manually inside of the racquet frame. The operator is required to manually weave a longitudinal string across pre-tensioned latitudinal strings. The operator must push the longitudinal string repeatedly "over and under" for each of the latitudinal string pairs (typically 18 strings, or 9 pairs). The operator then continues this process for each hole pair of the longitudinal pattern (typically 20 pairs, or 40 holes). This method of manual weaving is typically labor intensive, and represents the vast majority of time spent during the stringing process. Racquet technicians can typically string up to 15 racquets during a work day, which leads to hand fatigue, and can often lead in weave mistakes resulting in additional lost time.

Additionally, there is a significant barrier to entry for a racquet technician due to the high level of dexterity required. This is typically overcome during a training period. Depending on the level of dexterity and user exposure, the training period can take a significant amount of time before the technician is capable of consistently producing a strung racquet without errors within an acceptable time limit.

SUMMARY OF THE INVENTION

An automatic string weaving system in accordance with an aspect of the invention represents advancement to current stringing methods by automating the weaving process, thereby reducing the time required to string a racquet, the barrier to entry, and the fatigue experienced by the technician during many cycles.

The automatic string weaving system eliminates the problems with manual weaving, and automated weaving using complex assemblies, which involved robotic systems including one or more of the following; a plurality of pressure pins, pressurized systems, robotic manipulators/heads/columns, winding machines, guide wires, or any other object required to displace the tennis string in order to achieve the weave. Due to the solid-state design of the automatic string weaving system, no manipulation (either by user or by mechanical/electromechanical interface) is required during the weaving process, thereby eliminating these additional components and processes.

The automatic string weaving system represents a significant step forward towards a fully automated stringing system by eliminating the need for manual weaving, and thereby significantly reducing the stringing time when compared to current methods. The automatic string weaving system comprises a solid-state mechanical design using minimal components, whereby the string is automatically woven following the insertion of the string into the device by the technician. This solid-state weave design enables a severe reduction in complexity compared to alternative automatic weaving processes, which ultimately lowers the cost of manufacturing, as well as required maintenance.

An additional aspect of the invention involves an automatic string weaving system for weaving strings for a stringed sports racquet, comprising a weave assembly that the strings for the stringed sports racquet are weaved through; and an automated string feeder assembly to automatically weave the strings for the stringed sports racquet through the weave assembly.

One or more implementations of the aspect of the invention described immediately above includes one or more of the following: the automated string feeder assembly is configured to automatically and rapidly weave string of various diameter, stiffness, and material properties through the weave assembly; the automated string feeder assembly is a smart automated string feeder assembly including a photo interrupter that reports state detection of the string, an encoder that reports at least one of position and speed of the string, a current measuring device that reports torque of the string, and a tensioner that accommodates a variety of string diameters; the automated string feeder assembly is configured to detect a presence of a string and advance the string into the weave assembly as long as the presence of the string is detected; the automated string feeder includes a detector to detect the presence of the string; the detector is a photo interrupter; the automated string feeder includes a motor to impart motion to advance the string into the weave assembly; the automated string feeder includes a motorized feeder wheel that directly engages the string to advance the string into the weave assembly; the motorized feeder wheel includes a traction surface to facilitate engagement of the string to advance the string into the weave assembly; the automated string feeder includes a clamp that clamps onto the string and advances the string into the weave assembly; the automated string feeder includes at least one hardware processor, and one or more software modules that, when executed by the at least one hardware processor, assimilates sensory information from the automated string feeder assembly, and uses this sensory information to control speed, position, and acceleration of the string in order to protect against string damage due to obstruction, and provide a better user experience; the automated string feeder includes at least one hardware processor, and one or more software modules that, when executed by the at least one hardware processor, detects the presence of the string and advances the string into the weave assembly as long as the presence of the string is detected; the weave assembly includes a string receiving geometry configured to provide both mains strings and cross strings to be woven so that neither all of the mains strings nor all of the cross strings are in the same plane, reducing amplitude of woven mains strings and cross strings and reducing force required to push strings through the string receiving geometry of the weave assembly; the weave assembly is a two-piece weave assembly including a top member and a bottom member with harmonious weaving geometry including mains and crosses to weave both the string rows and string columns, while also allowing for separation of the top member from the bottom member to allow operator access to the strings; the top member includes a top subassembly with user controls, a middle subassembly with a printed circuit board, and a bottom subassembly with weave geometry; the user controls allow the operator to operate manual feed, stop, and reverse operations; the weave assembly includes longitudinal and latitudinal channels that the strings are weaved through, and the longitudinal and latitudinal channels each include either a SINE, COSINE TRAPEZOIDAL wave, which when combined, produces an interlocking weave, thereby reducing required torque and friction required to move the string through the longitudinal and latitudinal channels; the longitudinal and the latitudinal channels are configured to produce interlocking weave that has a string weave amplitude that is 2×(string height/2); a stand assembly; and/or the stand assembly includes a telescoping stand.

Another aspect of the invention involves a method of using the automatic string weaving system, the automatic string weaving system for weaving strings for a stringed sports racquet comprising a weave assembly that the strings for the stringed sports racquet are weaved through; and an automated string feeder assembly to automatically weave the strings for the stringed sports racquet through the weave assembly, the method comprising inserting the strings into orifices on one side of the weave assembly; advancing and weaving the strings into and through the weave assembly with the automated string feeder assembly to an opposite side of the weave assembly.

One or more implementations of the aspect of the invention described most immediately above includes one or more of the following: the automated string feeder assembly is configured to automatically and rapidly weave string of various diameter, stiffness, and material properties through the weave assembly; the automated string feeder assembly is a smart automated string feeder assembly including a photo interrupter that reports state detection of the string, an encoder that reports at least one of position and speed of the string, a current measuring device that reports torque of the string, and a tensioner that accommodates a variety of string diameters; the automated string feeder assembly is configured to detect a presence of a string and advance the string into the weave assembly as long as the presence of the string is detected; the automated string feeder includes a detector to detect the presence of the string; the detector is a photo interrupter; the automated string feeder includes a motor to impart motion to advance the string into the weave assembly; the automated string feeder includes a motorized feeder wheel that directly engages the string to advance the string into the weave assembly; the motorized feeder wheel includes a traction surface to facilitate engagement of the string to advance the string into the weave assembly; the automated string feeder includes a clamp that clamps onto the string and advances the string into the weave assembly; the automated string feeder includes at least one hardware processor, and one or more software modules that, when executed by the at least one hardware processor, assimilates sensory information from the automated string feeder assembly, and uses this sensory information to control speed, position, and acceleration of the string in order to protect against string damage due to obstruction, and provide a better user experience; the automated string feeder includes at least one hardware processor, and one or more software modules that, when executed by the at least one hardware processor, detects the presence of the string and advances the string into the weave assembly as long as the presence of the string is detected; the weave assembly includes a string receiving geometry configured to provide both mains strings and cross strings to be woven so that neither all of the mains strings nor all of the cross strings are in the same plane, reducing amplitude of woven mains strings and cross strings and reducing force required to push strings through the string receiving geometry of the weave assembly; the weave assembly is a two-piece weave assembly including a top member and a bottom member with harmonious weaving geometry including mains and crosses to weave both the string rows and string columns, while also allowing for separation of the top member from the bottom member to allow operator access to the strings; the top member includes a top subassembly with user controls, a middle subassembly with a printed circuit board, and a bottom subassembly with weave geometry; the user controls allow the operator to operate manual feed, stop, and reverse operations; the weave assembly includes longitudinal and latitudinal channels that the strings are weaved through, and the longitudinal and latitudinal channels each include either a SINE, COSINE TRAPEZOIDAL wave, which when combined, produces an interlocking weave, thereby reducing required torque and friction required to move the string through the longitudinal and latitudinal channels; the longitudinal and the latitudinal channels are configured to produce interlocking weave that has a string weave amplitude that is 2×(string height/2); a stand assembly; the stand assembly includes a telescoping stand; all mains strings are first processed through the weave assembly and then cross strings are weaved through the mains strings with the weave assembly; the weave assembly includes a top member and a bottom member, and following weaving the strings into and through the weave assembly, removing the top member from the bottom member to expose woven cross strings and main strings; and/or clamping and tightening the strings with a tension mechanism to complete stringing process.

BRIEF DESCRIPTION OF DRAWINGS

The accompanying drawings, which are incorporated in and form a part of this specification illustrate embodiments of the invention and together with the description, serve to explain the principles of the invention.

FIG. 9B shows internal mechanisms of the feeder assembly;

DESCRIPTION OF EMBODIMENT OF THE INVENTION

With reference to FIGS. 1B-15, an embodiment of an automatic string weaving system 100 for a stringed sports racquet 110 and method of manufacturing same will be described. As used herein, the term "racquet" is applicable to tennis, badminton, racquetball as well as any other sports equipment having an oval/circular head, with a woven string pattern.

Figure 1A:
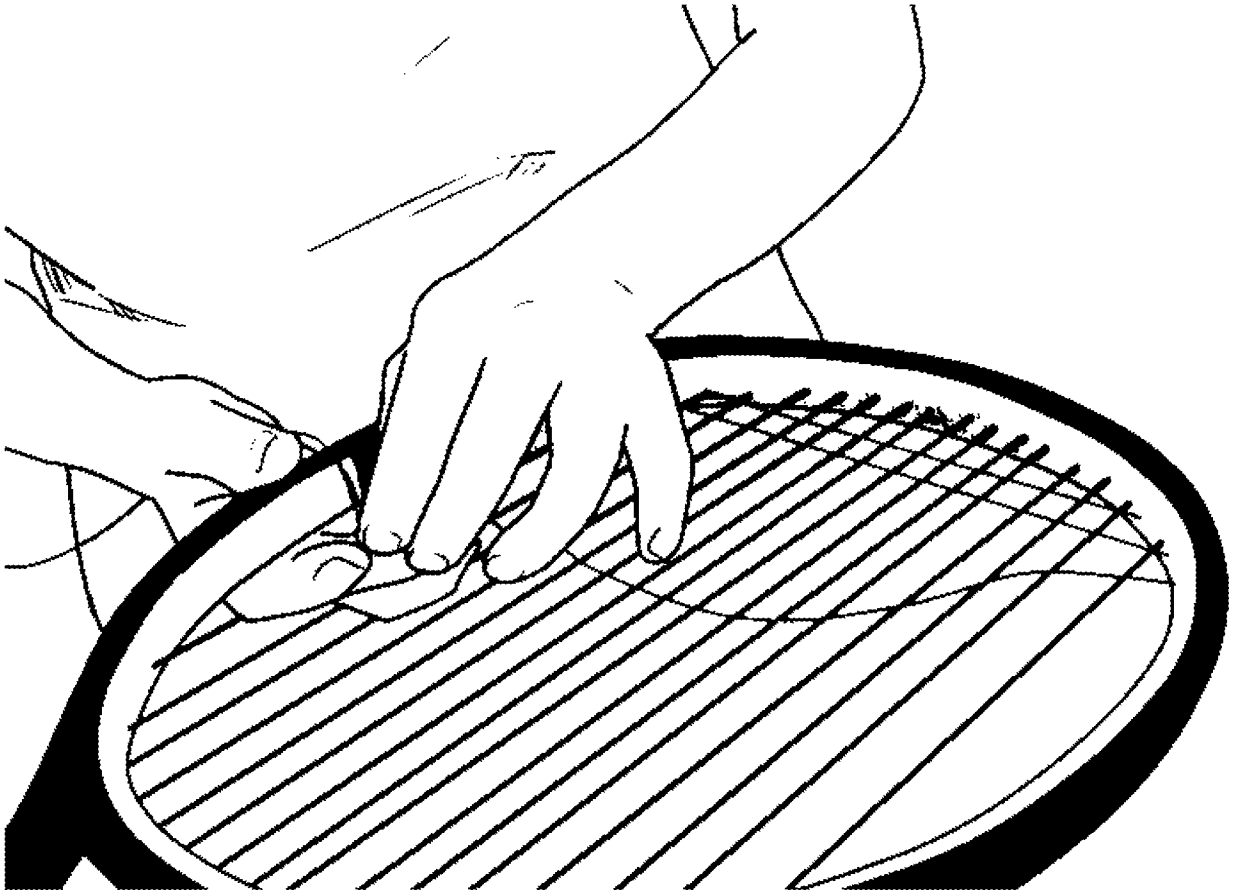
FIG. 1A (Prior Art)
FIG. 1A is a partial perspective view of a tennis racquet being stringed by operator using a stringing/weaving method used in the past.
Figure 1B:
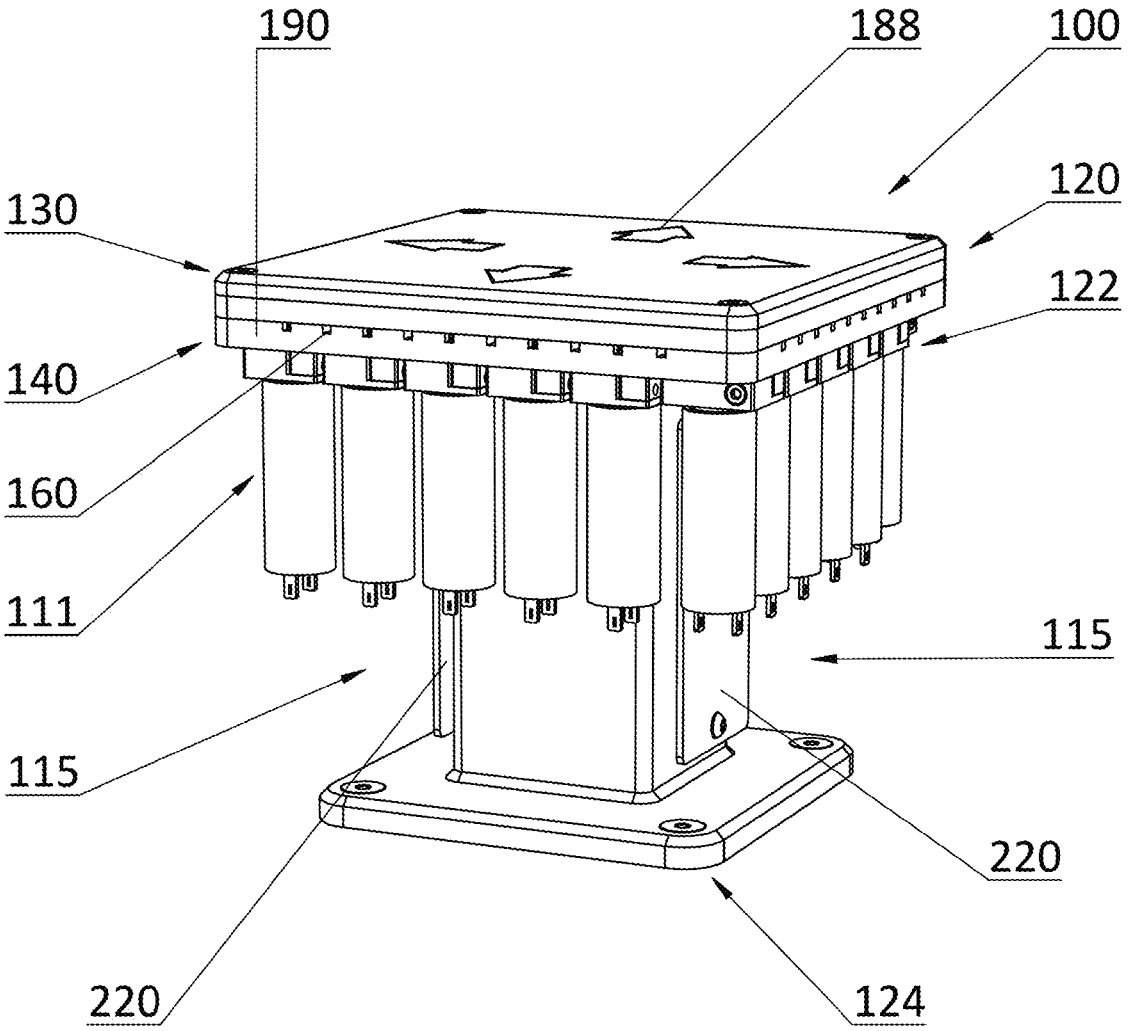
FIG. 1B is a perspective view of an embodiment of an automatic weaving system that sits inside of a frame of stringed sports racquet, and automates the string weaving process.
Figure 4:
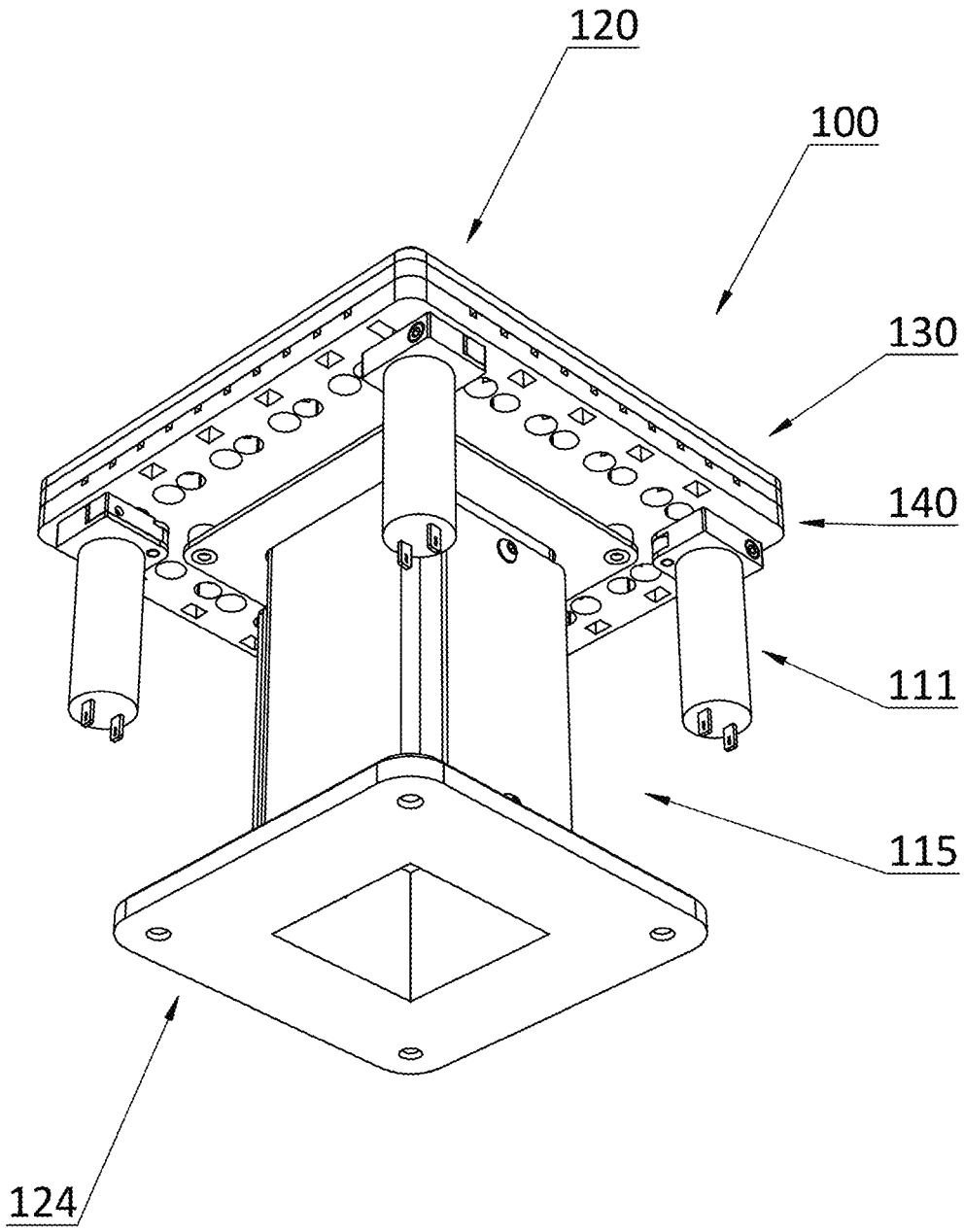
FIG. 4 is a bottom perspective view of the automatic weaving system of FIG. 1 and shows mounting locations for a feeder assembly.

With reference to FIG. 1B, the automatic string weaving system our automatic weaving console 100 sits inside a frame of a sports racquet (e.g., tennis racquet), and automates the string weaving process for the sports racquet frame. FIG. 1B shows a half-scale model (10 cross rows×10 main columns) of the automatic string weaving system 100 because the full-scale automatic string weaving system 100 includes 20 cross rows×20 main columns. In FIG. 1B, all motors 111 are shown; in FIG. 2 and other figures, only corner motors 111 are shown for visibility and clarity of invention. Further, in the figures, aesthetic coverings, and racquet mount are removed for visibility and clarity of invention. The automatic string weaving system 100 includes three assemblies: a stand assembly 115, a weave assembly 120, and a feeder assembly 122 (FIG. 4 shows the mounting locations for the feeder assembly 122).

The stand assembly 115 includes a base 124 that supports a telescoping stand 126 for raising the weave assembly 120 for ease of access during stringing and lowering the weave assembly 120 for stow away during tensioning.

Figure 3:
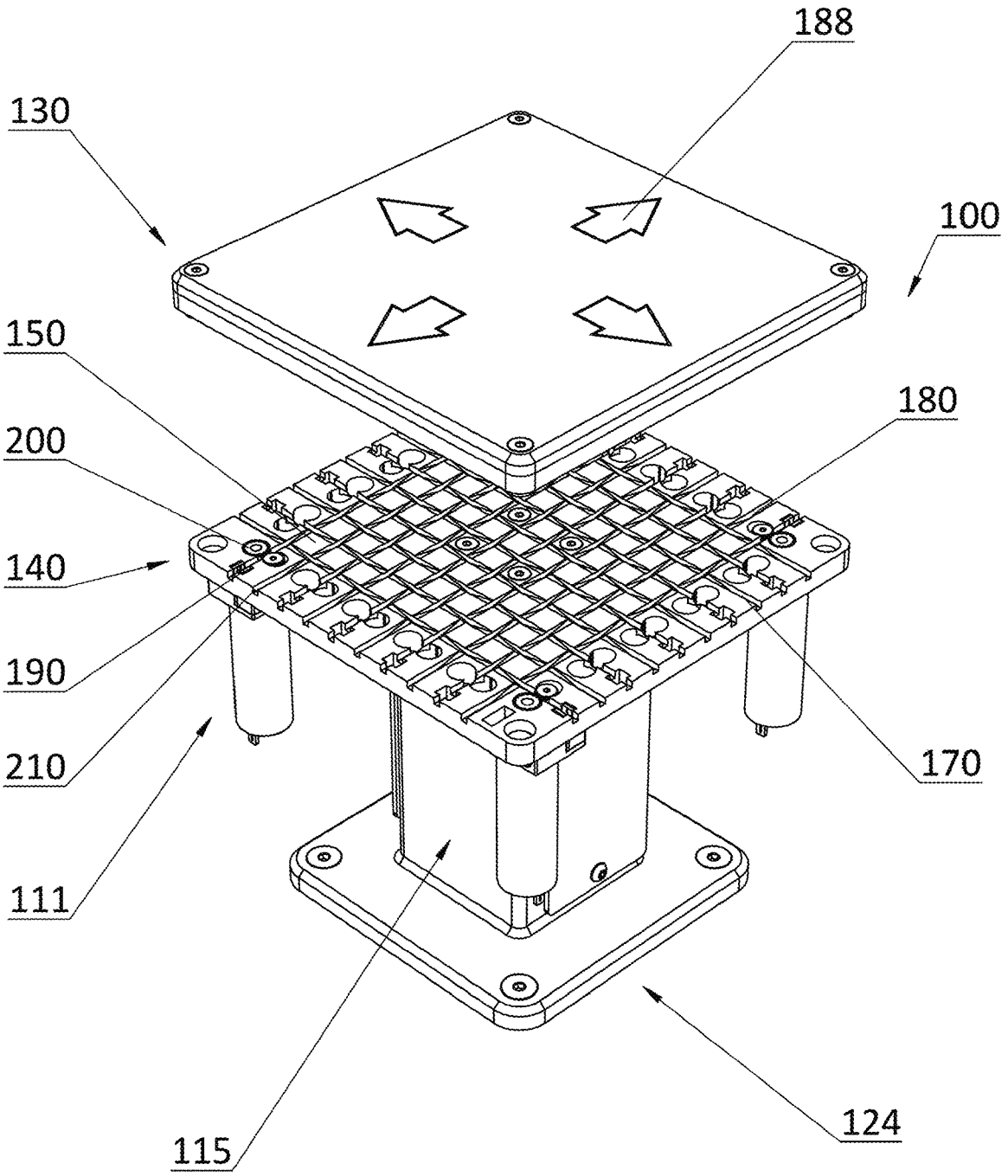
FIG. 3 is an exploded perspective view of weave geometry and a feeder assembly of the automatic weaving system of FIG. 1, and shows the removability of a top clamshell after weaving has taken place, allowing operator to access strings.

The weave assembly or split clamshell mold 120 automates the weaving process of a stringed sports racquet. The weave assembly 120 comprises a top clamshell 130 and a bottom clamshell 140, with harmonious weaving geometry 150 which includes columns (Mains) 170 and rows (Crosses) 180 for weaving of both the string rows and columns, while also allowing for a separation of the clamshell assembly 120 (e.g., removal of top clamshell 130 as shown in FIG. 3 to allow operator access to the strings) after the process. The geometry used inside of the clamshell mold 120 eliminates the need for any additional displacement or manipulation previously required to weave a tennis racquet. As a result, the automatic string weaving system 100 eliminates the need for previous complex assemblies such as a plurality of pressure pins, pressurized systems, robotic manipulators/heads, winding machines, guide wires, or any other object required to displace the tennis string in order to achieve the weave. The simplicity of the automatic string weaving system 100 reduces the cost of manufacturing, maintenance, and eliminates the need for expert users.

The top clam shell 130 is fixed to the bottom clam shell 140 through a magnetic latch. Another embodiment allows the top clam shell 130 to be attached to the bottom clam shell 140 through a mechanical attachment.

Figure 5:
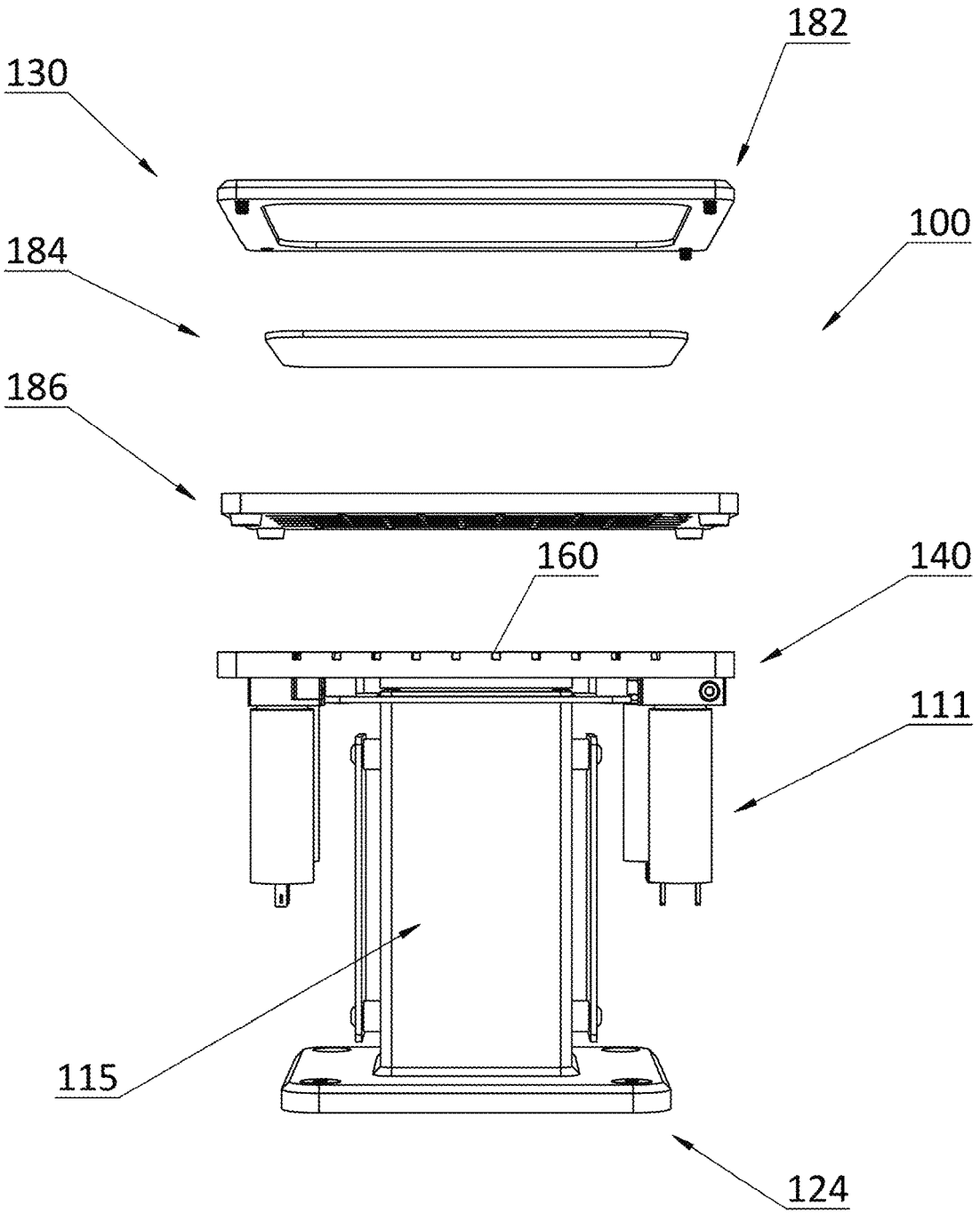
FIG. 5 is an exploded front elevational view of the automatic weaving system of FIG. 1 and shows three parts for top clamshell subassembly only for reference.
Figure 6:
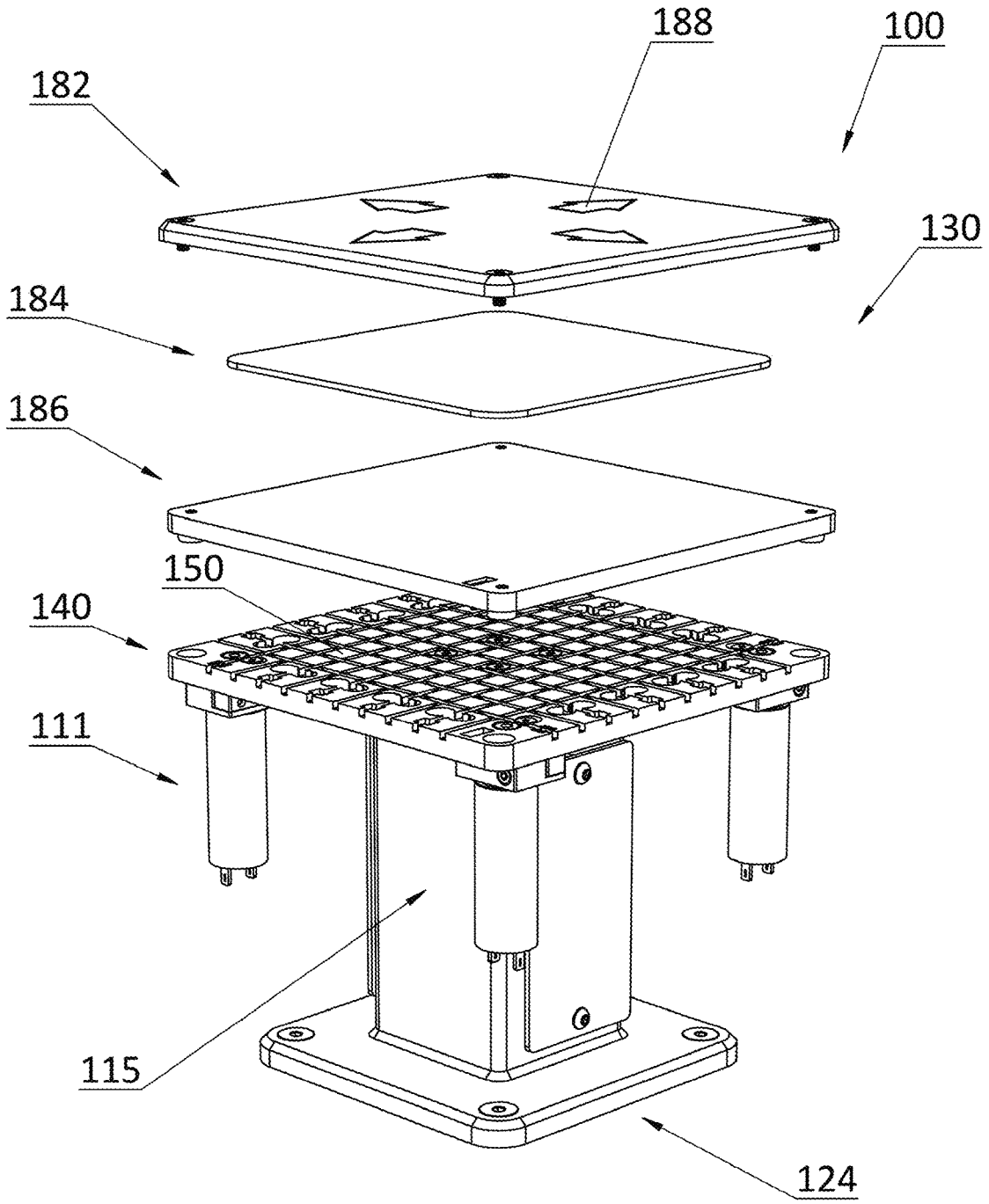
FIG. 6 is an exploded top perspective view of the automatic weaving system shown in FIG. 5, and shows touch buttons shown as top arrows.
Figure 7:
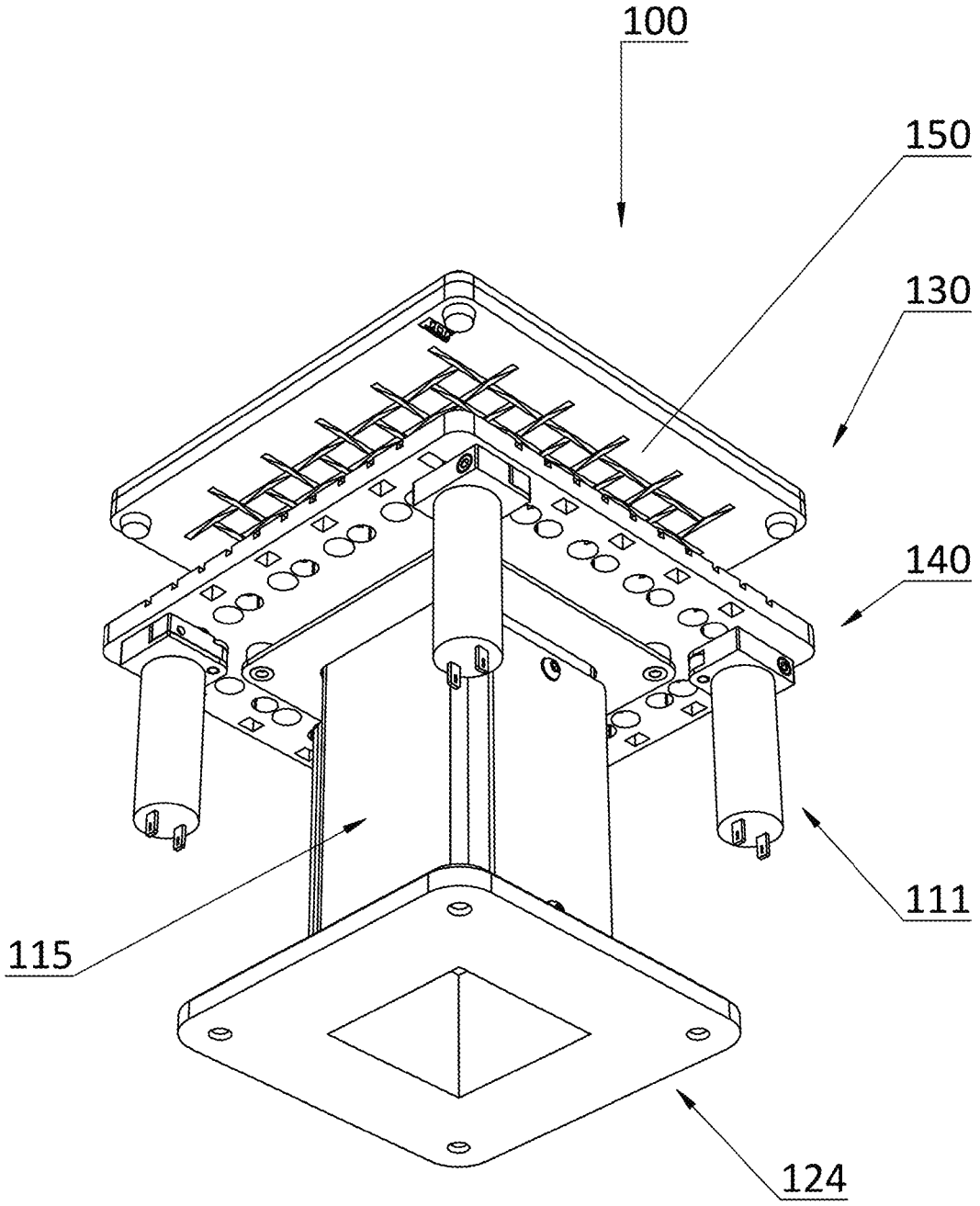
FIG. 7 is an exploded bottom perspective view of the automatic weaving system of FIG. 1.
Figure 8A:
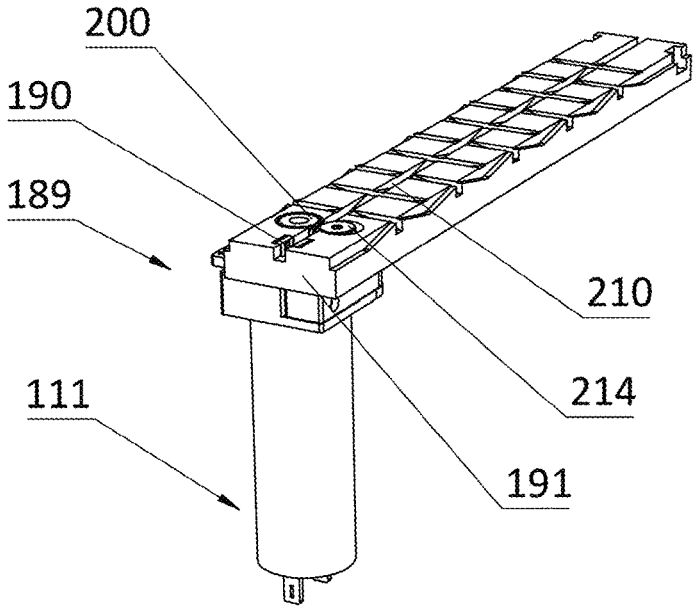
FIGS. 8A and 8B are a perspective view and a top plan view of a primary feeder with bottom clamshell section of the automatic weaving system of FIG. 1.
Figure 8B:
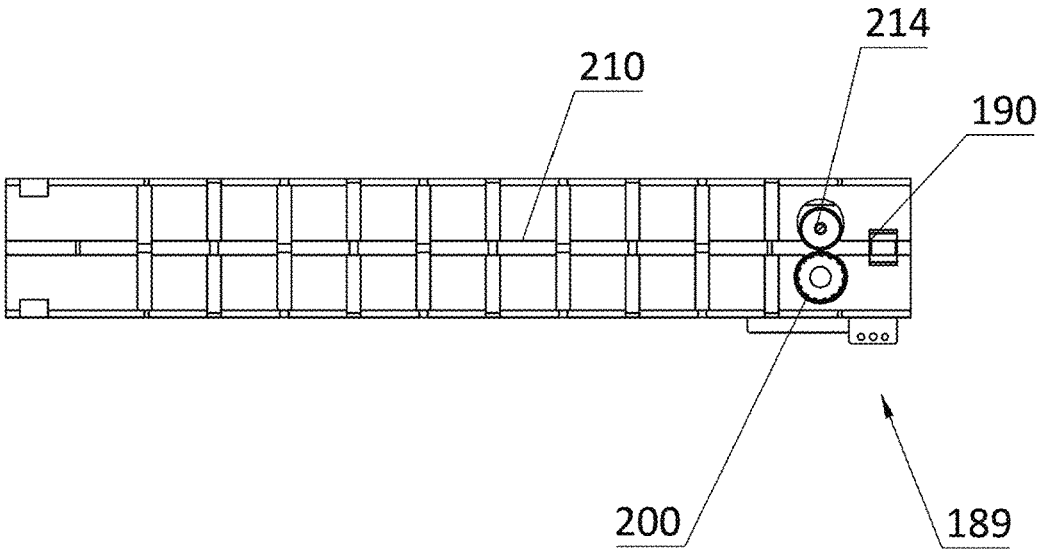

With reference to FIG. 5, the top clamshell 130 includes three sections/subassemblies: a top subassembly 182 having a solid geometry with user toggles, a middle subassembly 184 having a printed circuit board (PCB) with power, toggles, integrated circuit (TWI), connector(s), and a bottom subassembly 186 with weave geometry, alignment shear cones, and connector mount(s). The subassemblies 182, 184, 186 are combined via 4 countersunk m4 screws in each corner, a connector to PCB, and then PCB to toggles (e.g., capacitive touch sensors). The top clamshell 130 allows the operator to interact directly with the weaving process and enables co-robotic safety for manual feed, stop, reverse operations. As shown in FIG. 6, four arrows are capacitive touch buttons 188 that the user toggles to allow manual interaction with the automatic weaving console 100.

Figure 11:
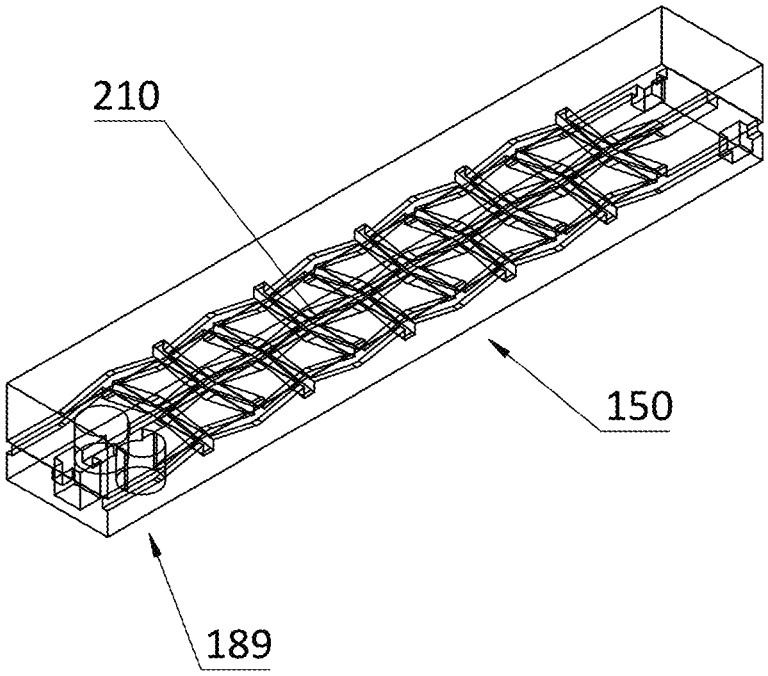
FIG. 11 is a perspective view of longitudinal and latitudinal channels for "mains" and "crosses" in weave geometry of combined top and bottom clamshell sections.
Figure 12:
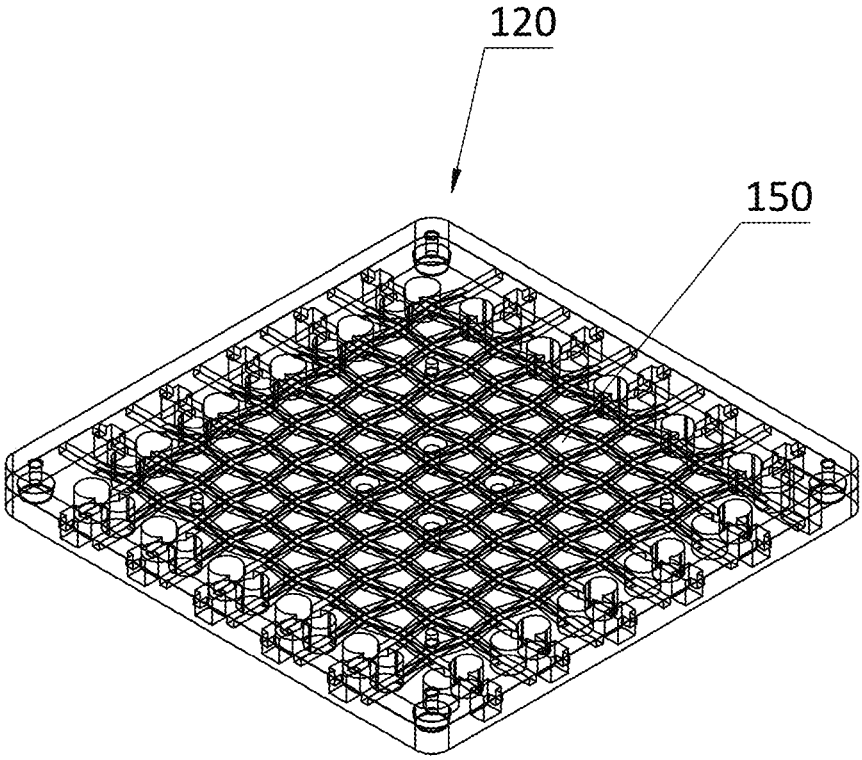
FIG. 12 is a perspective view of weave geometry of combined top and bottom clamshell sections.

As best shown in FIGS. 11 and 12, longitudinal and latitudinal channels for Mains 170 and Crosses 180 (e.g., for tennis racquet) have varying channel depths are provided in the weaving geometry 150. The top clamshell 130 and the bottom clamshell 140 mate at the shown split line. The top clamshell 130 is able to be removed without disturbing or being locked into the woven strings. Weave channels 210 weave string through perpendicular channels. The order of weaving is unimportant, but in a typical application, the order is the same workflow as for a tennis racquet. In FIGS. 11 and 12, both the main and cross strings woven in weaving geometry 150 shown, the amplitude of the weave (or the height that the string has to deform during the weave) is significantly smaller (approximately half of the amplitudes of sports racquet string weaves in the past), thereby reducing the force required to push the string through the geometry. Thus, because both main and cross strings are woven in the weaving geometry 150, neither all of the main strings nor all of the cross strings are in the same plane, as was done in the past, which required the woven strings (e.g., cross strings) to have a significantly greater angle of weave and amplitude of weave to weave throughout the main strings, which were all in the same plane, compared to the weaving geometry 150. The longitudinal and latitudinal channels 170, 180 possess a SINE, COSINE TRAPEZOIDAL wave, which when combined, produce an interlocking weave, thereby reducing the required torque, and thereby friction, required to move the string through said channel. This interlocking weave has a string weave amplitude that is 2×(string height/2), which is much less than past weave channels for a single weave direction (the string weave amplitude was 2×(string diameter)).

With the aid of the automatic string weaving system 100, the racquet technician is able to insert the racquet string into an orifice 160 of the clamshell weaver assembly 120, and through a process controlled by the assembly geometry 150, the string exits the mirrored opposite side woven. The user will then repeat this operation, typically progressing through all columns (Mains) 170, and then moving on to rows (Crosses) 180 in a sequential manner. Following the weaving process, the technician removes the top clamshell 130 which exposes the woven cross and main strings. The technician is then required to clamp, and tighten the strings via a tension mechanism to complete the stringing process.

Figure 2:
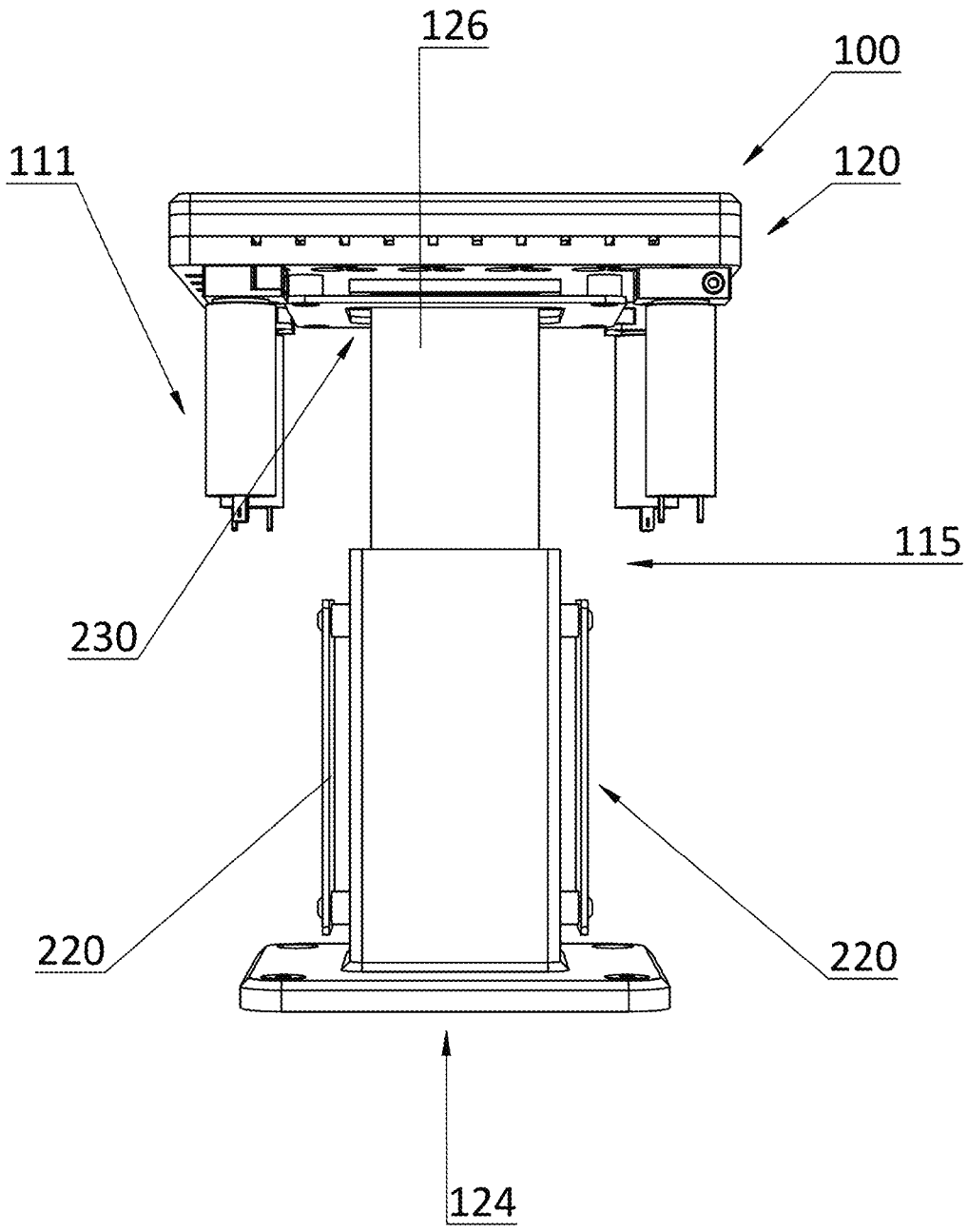
FIG. 2 is a front elevational view of the automatic weaving system of FIG. 1 and shows a telescoping stand at a base of the automatic weaving system.
Figure 9A:
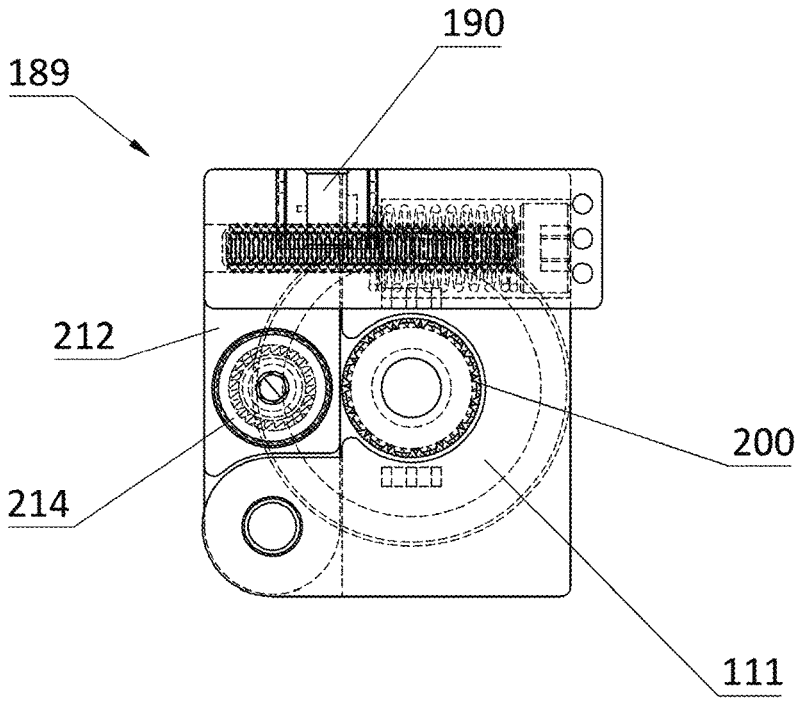
FIGS. 9A and 9B are top plan views of feeder assembly of the primary feeder of FIGS. 8A and 8B.
Figure 9B:
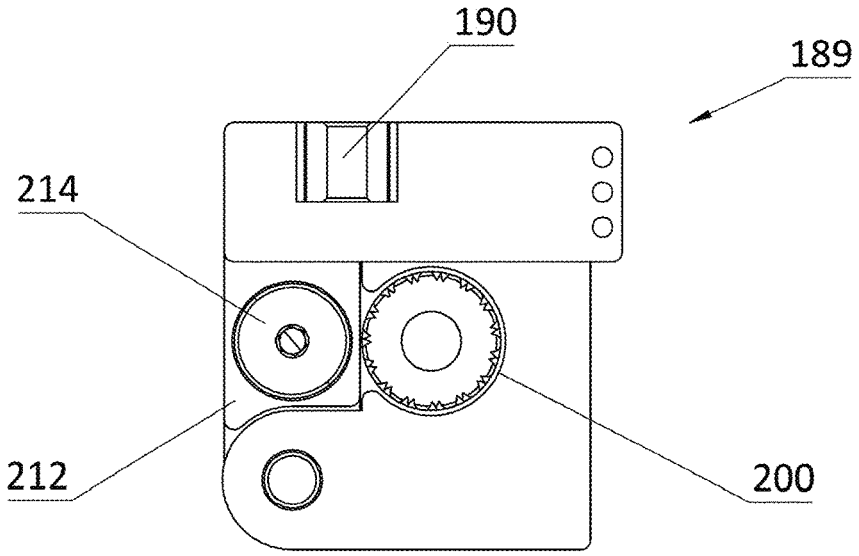
Figure 10:
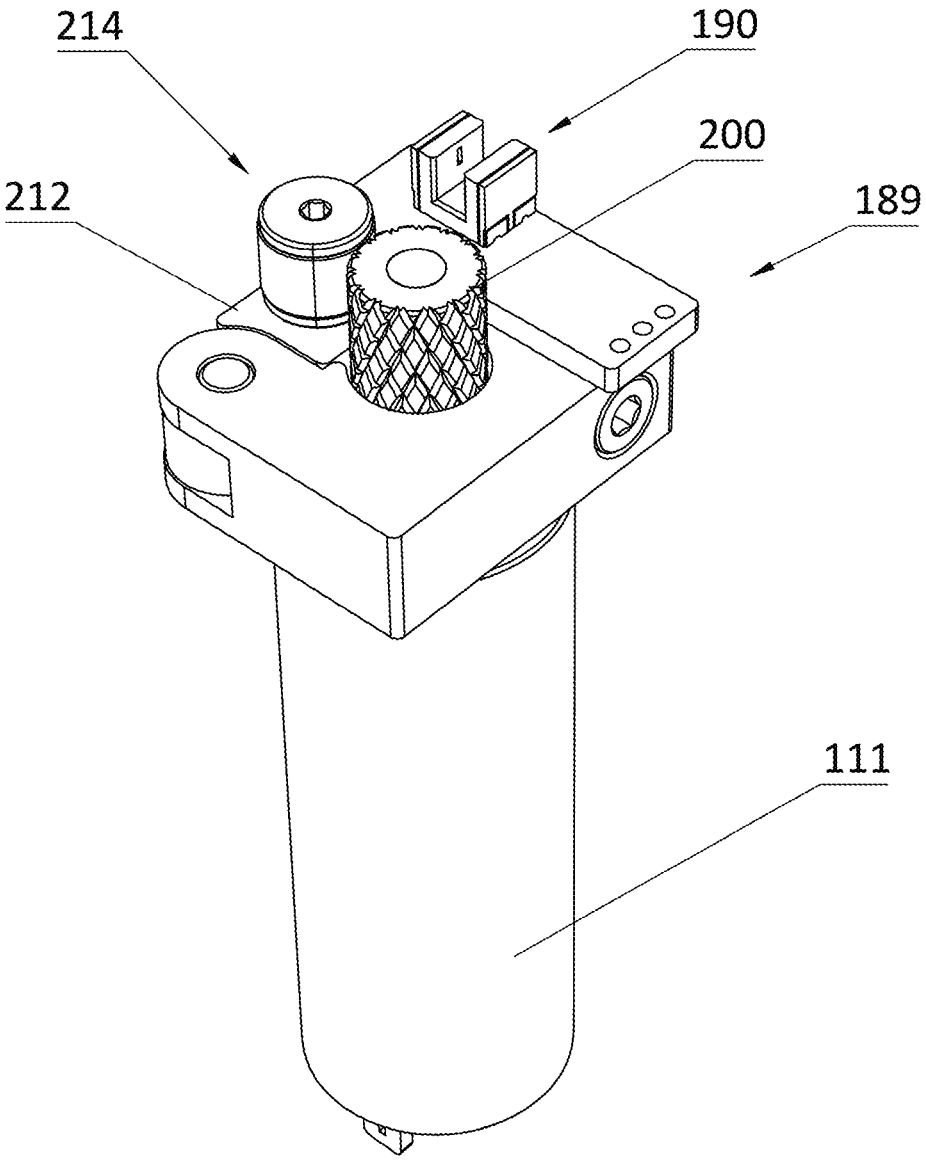
FIG. 10 is a top perspective view of the feeder assembly of the primary feeder of FIGS. 8A and 8B.

As shown best in FIGS. 8A-10, the feeder assembly 122 will be described in more detail. The feeder assembly 122 includes a plurality of feeders 189 for the columns (Mains) 170 and the rows (Crosses) 180 integrated within the bottom clamshell 140 of the weave assembly 120, adjacent to a peripheral edge 191 of the weave assembly 120. Each feeder 189 includes a photo interrupter 190 adjacent to the orifice 160 that allows the string to be recognized/detected (i.e., photo interrupter 190 detects user intent) once entered into the orifice 160, and motorized feeder wheels 200 adjacent to the orifice 160 that are driven by the motors 111 to move the string through weave channel 210 after it has been detected. The motors 111 are DC motors that are scalable to required torque, which is derived from length of geometry/material choice/string selection. As shown in FIGS. 9A, 9B, and 10, each feeder 189 includes a spring loaded lever 212 connected to a cam roller 214. While not required to weave, the motorized feeder wheels 200 and photo interrupter 190 facilitate a high-speed weave for both longitudinal and latitudinal cross section of the stringing process. Additionally, one or more printed circuit board(s) (PCB(s)) 220 located on telescoping stand assembly 115 (FIG. 2) of the automatic string weaving system 100 houses motor driver circuitry, processor for open loop control, and also handles the General Purpose Inputs and Outputs (GPIO) from the photo interrupters 190. FIG. 2 also shows the location of feeder sensor/motor contacts breakout PCB 230.

The material selection for the clamshell mold 120 has been designed to incorporate a low coefficient of friction, which enables the string to slide through the weave channel 210 with a minimal required force. Due to the dual weave design in both row and column directions, the height at which the string is required to move has been decreased, thereby increasing the bend radius, and further reducing the required force to push the string through the channel 210. Material selections such as steel, hard anodized aluminum, Teflon, and other low friction polymer blends may be used. Because the use of Teflon blended polymers can be selected for the clamshell design, the cost of manufacturing is further reduced when coupled with an injection molded process. The weave channel geometry also accommodates a draft angle, allowing for the use of injection molding techniques.

The grid pattern of the clamshell mold 120 may vary to accommodate a wide variety of string patterns. In the embodiments shown, a 10×10 grid pattern is shown for simplicity and to facilitate the reader's understanding of the invention. In a more preferred embodiment, the clamshell mold 120 includes a 20×20 grid pattern so that the user can use as many columns and rows as needed to fit the string pattern of their racquet (typically 16×20, 18×20).

Figure 13A:
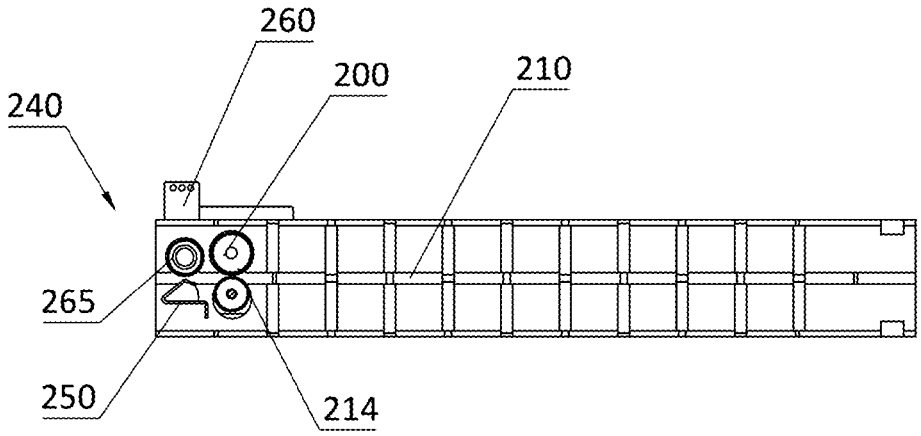
FIGS. 13A and 13B are a top plan view and a perspective view of an alternative embodiment of a primary feeder (with leaf spring and encoder) with bottom clamshell section of the automatic weaving system of FIG. 1.
Figure 13B:
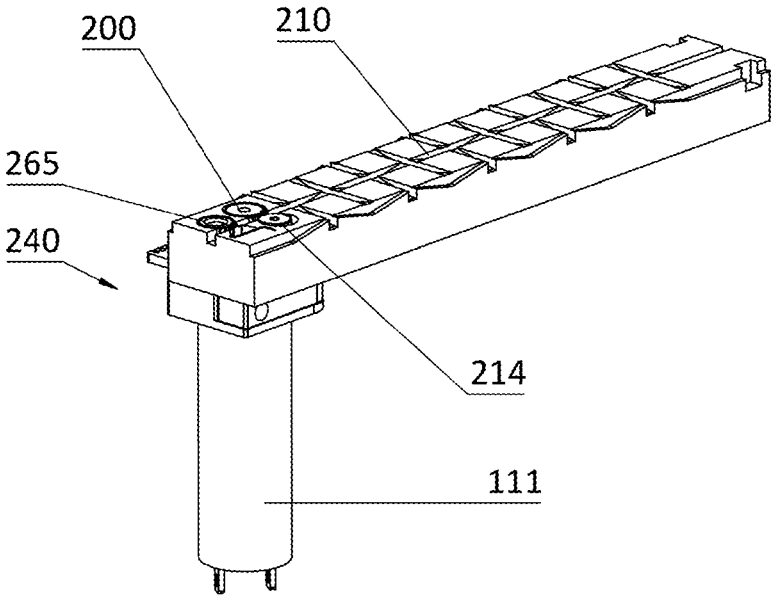

FIGS. 13A and 13B are a top plan view and a perspective view of an alternative embodiment of a primary feeder 240 (with leaf spring 250 and encoder 260 instead of photo interrupter 190 shown in FIGS. 8A-10) with bottom clamshell 140 of the automatic weaving system 100. The leaf spring 250 compresses the string onto encoder wheel 265. The magnetic encoder 260 ensures that the string is still moving through the channel 210 while the motor 111 is driving it. If the string catches on anything, or the feeder 189 has completed its task, and no additional string is left to move through the channel 210, the encoder 260 reports no motion detected, and the motor 111 stops. This prevents the feeder 189 from accidently stripping the string, and also allows more precise control.

Figure 13C:
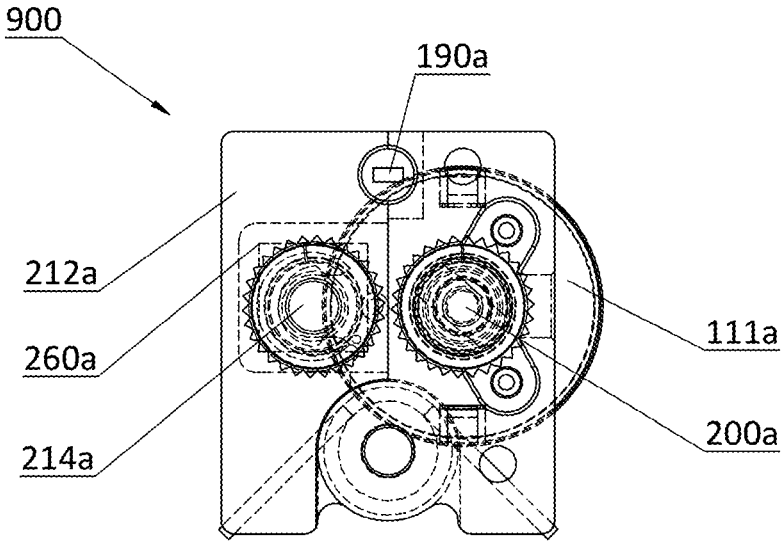
FIGS. 13C, 13D, and 13E are top plan views and an exploded perspective view of a further embodiment of a feeder assembly/primary feeder.
Figure 13D:
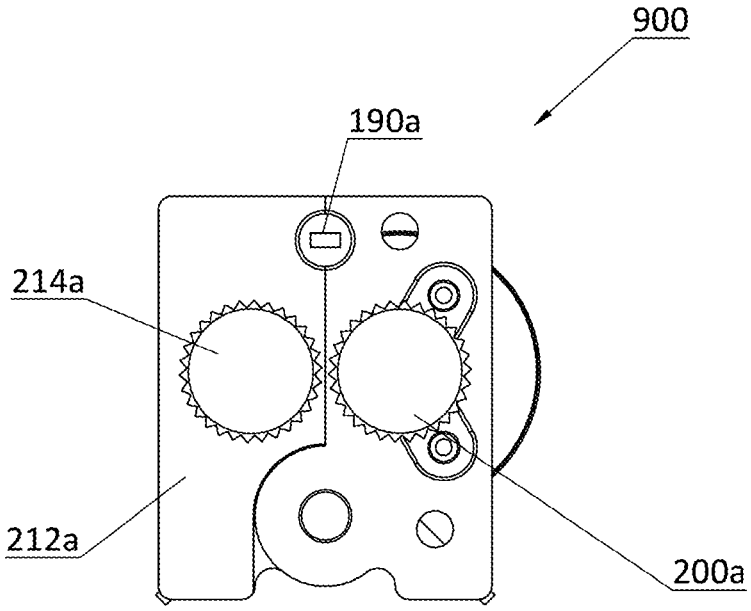
Figure 13E:
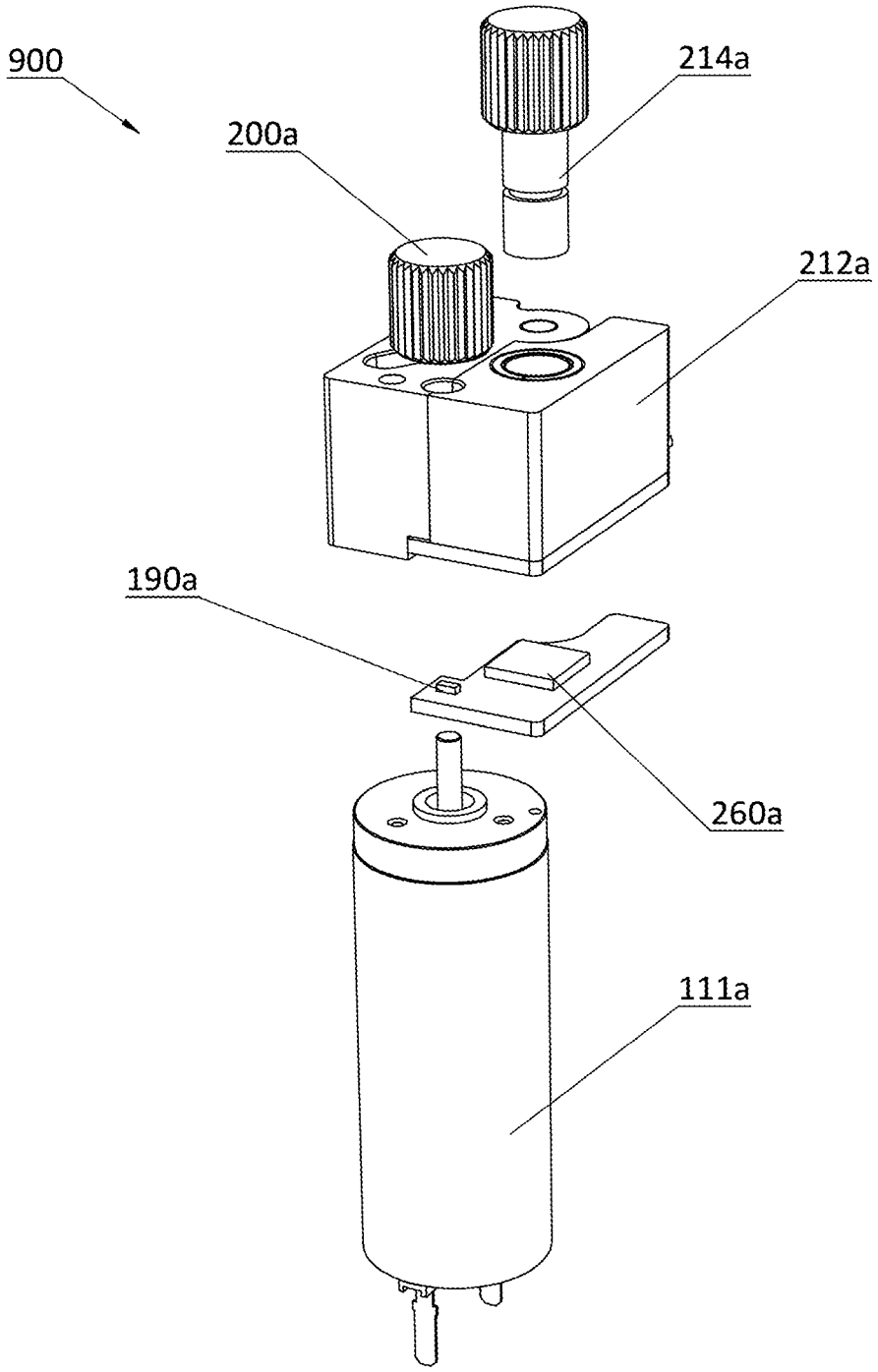

With reference to FIGS. 13C-13E, a further embodiment of a primary feeder 900 will be described. Similar elements to those shown and described herein are used with the same reference number, but with an "a" suffice (i.e., motor 111*a*, photo interrupter 190*a*, motorized feeder wheel 200*a*, spring loaded lever 212*a*, cam roller 214*a*, encoder 260*a*). The prior description of these elements is incorporated herein. The primary feeder 900 utilizes a motorized feeder wheel 200*a* with a traction surface (such as, but not limited to a straight knurled surface). The cam roller 214*a* also has a traction surface (such as, but not limited to a straight knurled surface) 910. The cam roller 214*a* has a diametrically polarized magnetic cylinder inside the shaft. When used with the encoder IC/PCB 260*a*, the primary feeder 900 produces rotational sensing, which is then used to calculate the distance that the string has traveled, as well as fault protection (if string gets snagged on something). Below the spring loaded lever 212*a*, resides feeder printed circuit board (PCB) 920. This PCB 920 has been integrated with a rotary magnetic encoder integrated circuit (IC), and a photo interrupter surface mount device (SMD)/photo interrupter 190*a*. The spring-loaded lever 212*a* differs only slightly in this embodiment from the embodiment of spring-loaded lever 212 in FIGS. 9A, 9B, 10. The use of a torsion spring lends itself well to the rotational motion of the cam lever, which prevents binding, and enables more surface area for the magnetic encoder to sit on the PCB 920 below the spring loaded lever 212*a*.

Figure 13F:
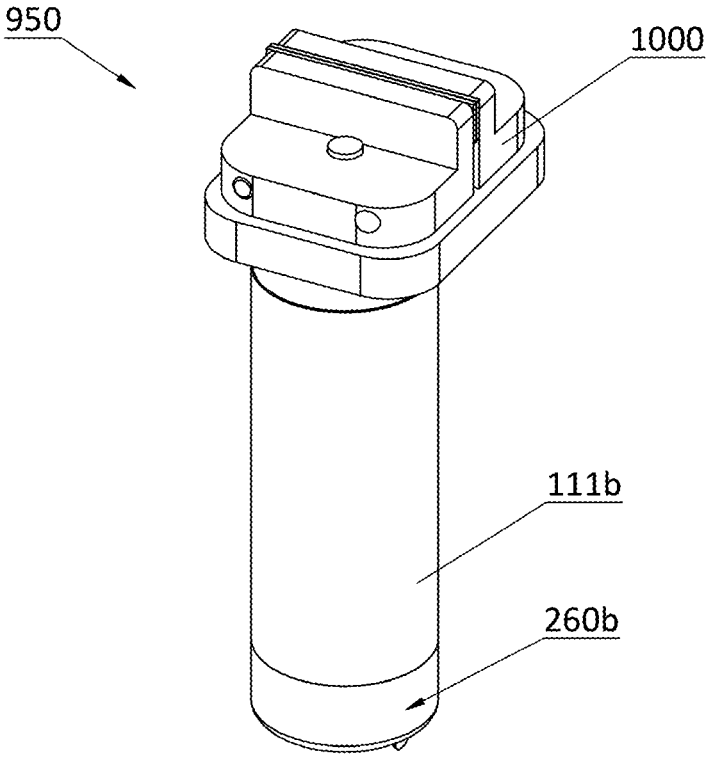
FIGS. 13F and 13G are a perspective view and an exploded perspective view of a still further embodiment of a primary feeder/feeder assembly.
Figure 13G:
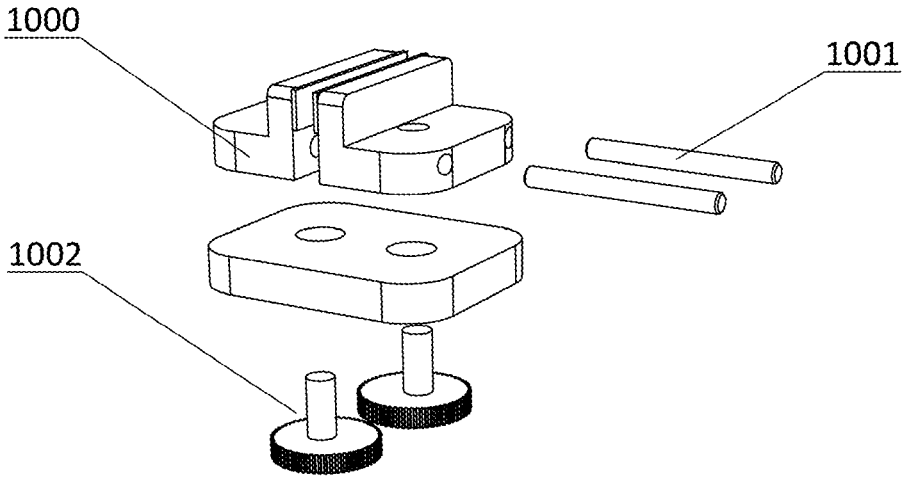

With reference to FIGS. 13F and 13G, a still further embodiment of a string feeder 950 will be described. Similar elements to those shown and described herein are used with the same reference number, but with an "b" suffice (i.e., motor 111*b*, encoder 260*b*). In this embodiment, two grippers 1000 are used to clamp and advance the string through the weave geometry. Two parallel linkage linear shafts 1001 keep the grippers parallel to each other at all times. The eccentric geared rotary shafts 1002 rotate (one driven by the motor 111*b* turns the other) the eccentric shafts, which in turn move the parallel grippers 1000. The encoder 260*b* is attached directly to the motor 111*b*, which allows the rotational position of the motor shaft, and thereby the gripper position to be sensed. This is useful for distance sensing, and releasing the string when it is time to remove the string weave from the weaver.

This embodiment allows the feeder 950 to clamp and advance the string through the weave geometry. Its larger surface area provides higher traction on the string, and reduces the potentially destructive notching caused by a knurled surface (in the case of the rotary feeder 900).

Figure 14:
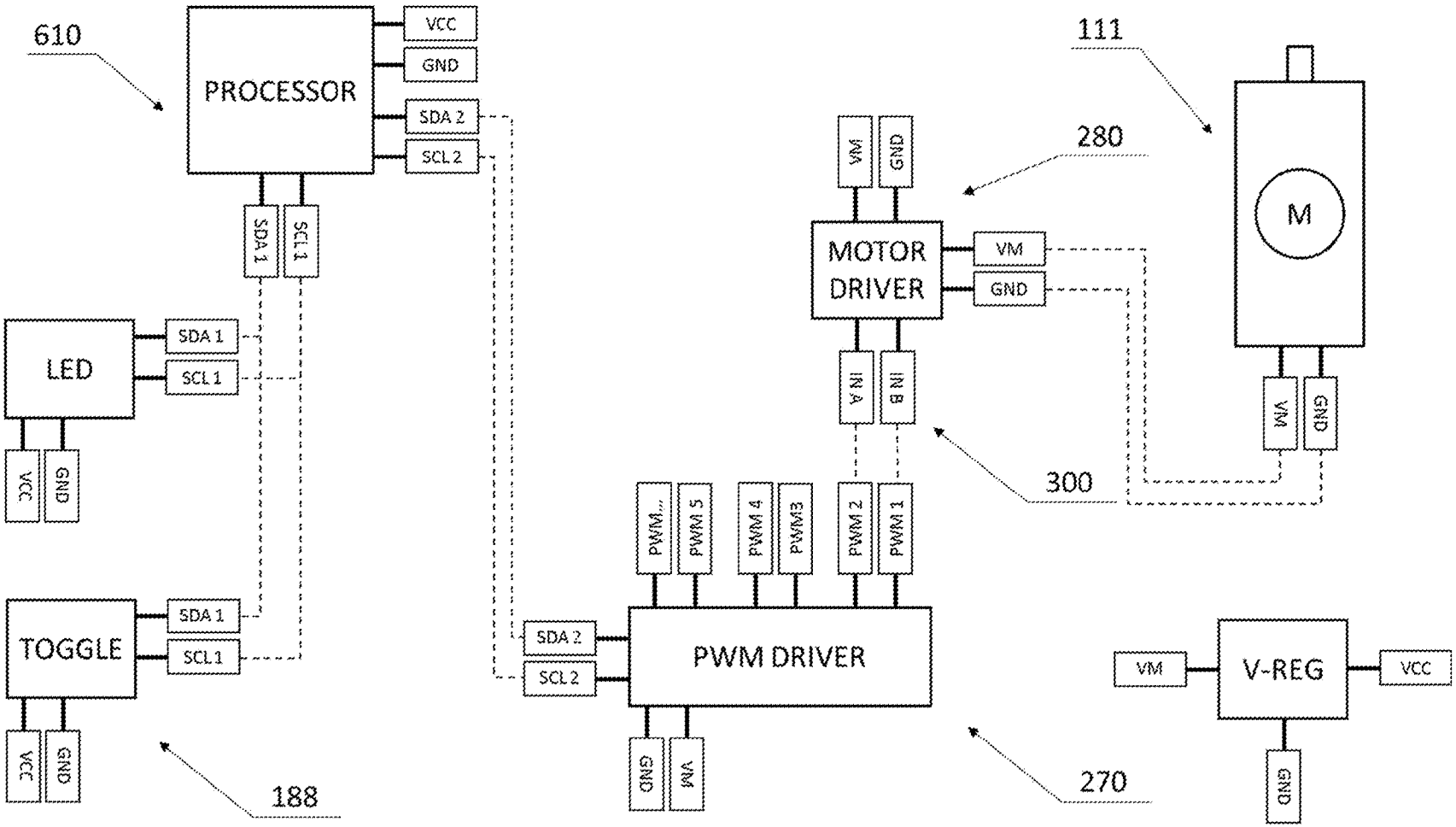
FIG. 14 is a schematic of electronics of the automatic weaving system of FIG. 1.

FIG. 14 is a schematic of exemplary electronics of the automatic weaving system 100. A processor 610 connects to a pwm driver 270 which connects to a motor driver 280 which connects to motor 111. Communications operate over a high-speed TWI connection. The motor driver 280 can produce a directional output (string forwards, string reverse), as well as dynamically controlled current monitoring (for torque limiting). The toggles 188 and LEDs 290 are also connected over TWI directly to the processor 610. All present TWI devices have selectable addresses from 0-128. The full assembly consists of 20 crosses and 18 mains. Each channel has a dedicated feeder. Each feeder has a dedicated motor 111, photo interrupter 190, and encoder (optional). Each motor 111 requires motor driver 280, and each motor driver 280 requires 3 PWM inputs (IN1, IN2, and Vref). Pwm pins 300 to the motor driver 280 are driven by the multi-channel pwm driver 270, which can also be daisy chained, and addressed from 0-128, thus providing plenty of room for expansion. This communications protocol can be used for large GPIO (general purpose input and output) requirements when high speed is required, and distance is not >1 meter. It enables the use of 2 lines for communication (Data/Clock).

Figure 15:
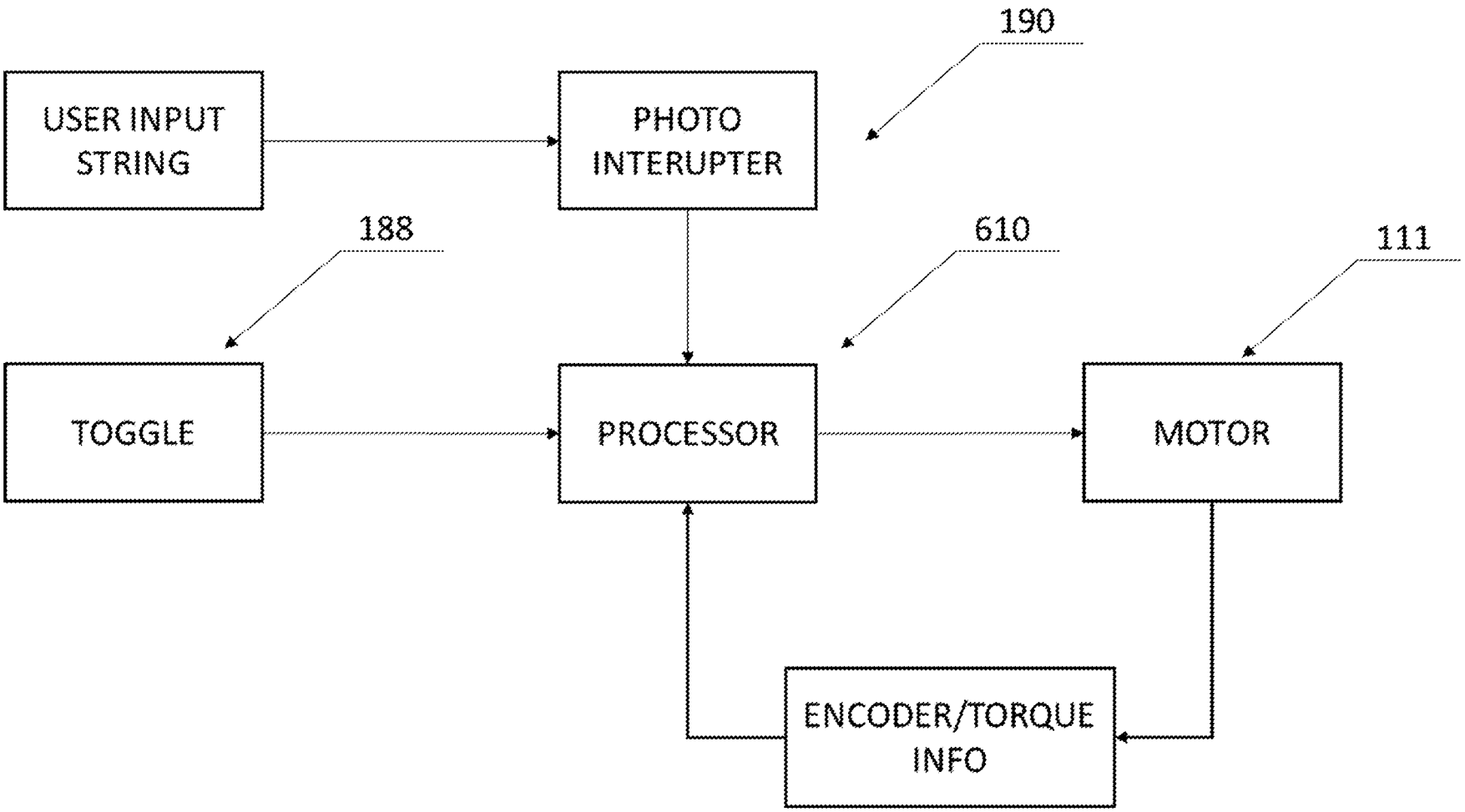
FIG. 15 is an exemplary workflow diagram for automatic weaving system of FIG. 1.

FIG. 15 is an exemplary workflow diagram for the automatic weaving system of FIG. 1. A user inputs the string through the orifice 160 of the clamshell weaver assembly 120 and into the photo interrupter 190. The photo interrupter 190 senses the presence of the string and notifies processor 610. The toggles 188 are used to instruct the processor 610 to control the motor 111 to prematurely stop, reverse, or manually feed the string at any time through the geometry 150 of the clamshell mold 120. Torque/encoder information is used to determine when the string has been thoroughly woven, and the feeder 189 can stop working.

The feeders 189 can also be used collectively, in order to provide tensioning on the string(s) (i.e., once the user has woven all string(s) through the geometry, all feeders 189 are collectively used in series to produce a cumulative tension on the string(s)). The string(s) is/are then clamped and tied, and the top clamshell 130 is removed.

The bottom clamshell 140 has four clamps, in each corner of the weave geometry 150. This enables the automated clamping of the strings after collective tension has been completed. The user is then only required to tie off the string following collective tension mode.

The top clamshell 130 and the bottom clamshell 140 are split 2-4 times along the longitudinal axis. The split sections are connected via two precision rails, which enable the sections to move along the latitudinal axis independently, or together. The split sections are then connected via a spring element. In their natural state the split sections are together. During collective tension, the split sections can separate from each other, thus allowing an adaptive geometry which aids in conforming to the racquet frame. During tension, this alleviates any issue that would be caused by imperfect hole alignment.

The processor 610 can store user information, including but not limited to user tension, and string data to be stored by a cloud based SQL. This information can then be accessed, and used to send reminders to users.

The automatic weaving system 100 has the ability to automatically, and rapidly weave string of various diameter, stiffness, and material properties through the weave assembly 120, which is a solid state, 2-piece design. The automatic weaving system 100 uses a "smart" feeder design, which reports state detection via photo interrupter, position/speed via encoder, torque via current, and accommodates a variety of string diameters via tensioner. The automatic weaving system 100 uses the processor to assimilate sensory information from the smart feeders/user, and to use this information to control the speed, position, and acceleration of the string in order to protect against string damage due to obstruction, and provide a better user experience.

Figure 16:
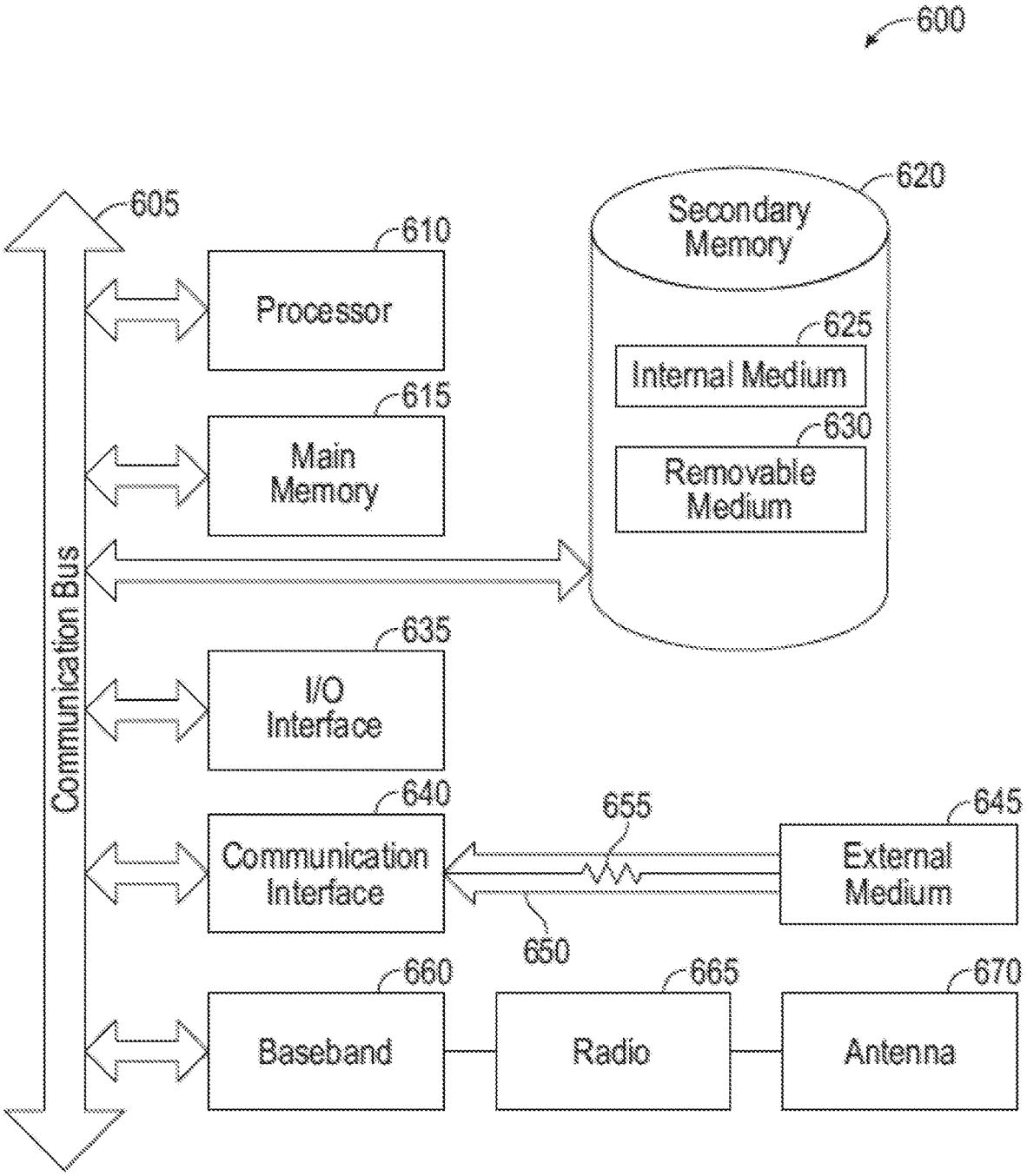
FIG. 16 is a block diagram of an example processing system, by which one or more of the processes described herein, may be executed, according to an embodiment.

FIG. 16 is a block diagram illustrating an example wired or wireless system 600 that may be used in connection with various embodiments described herein. For example, system 600 may be used as or in conjunction with one or more of the functions, processes, or methods (e.g., to store and/or execute the application or one or more software modules of the application) described herein. System 600 can be any type of computer or any other processor-enabled device that is capable of wired or wireless data communication. Other computer systems and/or architectures may be also used, as will be clear to those skilled in the art.

System 600 preferably includes one or more processors, such as processor 610. Additional processors may be provided, such as an auxiliary processor to manage input/output, an auxiliary processor to perform floating-point mathematical operations, a special-purpose microprocessor having an architecture suitable for fast execution of signal-processing algorithms (e.g., digital-signal processor), a slave processor subordinate to the main processing system (e.g., back-end processor), an additional microprocessor or controller for dual or multiple processor systems, and/or a coprocessor. Such auxiliary processors may be discrete processors or may be integrated with processor 610. Examples of processors which may be used with system 600 include, without limitation, the Pentium® processor, Core i7® processor, and Xeon® processor, all of which are available from Intel Corporation of Santa Clara, Calif.

Processor 610 is preferably connected to a communication bus 605. Communication bus 605 may include a data channel for facilitating information transfer between storage and other peripheral components of system 600. Furthermore, communication bus 605 may provide a set of signals used for communication with processor 610, including a data bus, address bus, and/or control bus (not shown). Communication bus 605 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, standards promulgated by the Institute of Electrical and Electronics Engineers (IEEE) including IEEE 488 general-purpose interface bus (GPIB), IEEE 696/S-100, and/or the like.

System 600 preferably includes a main memory 615 and may also include a secondary memory 620. Main memory 615 provides storage of instructions and data for programs executing on processor 610, such as one or more of the functions and/or modules discussed herein. It should be understood that programs stored in the memory and executed by processor 610 may be written and/or compiled according to any suitable language, including without limitation C/C++, Java, JavaScript, Perl, Visual Basic, .NET, and the like. Main memory 615 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

Secondary memory 620 may optionally include an internal medium 625 and/or a removable medium 630. Removable medium 630 is read from and/or written to in any well-known manner. Removable storage medium 230 may be, for example, a magnetic tape drive, a compact disc (CD) drive, a digital versatile disc (DVD) drive, other optical drive, a flash memory drive, and/or the like.

Secondary memory 620 is a non-transitory computer-readable medium having computer-executable code (e.g., disclosed software modules) and/or other data stored thereon. The computer software or data stored on secondary memory 620 is read into main memory 615 for execution by processor 610.

In alternative embodiments, secondary memory 620 may include other similar means for allowing computer programs or other data or instructions to be loaded into system 600. Such means may include, for example, a communication interface 640, which allows software and data to be transferred from external storage medium 645 to system 600. Examples of external storage medium 645 may include an external hard disk drive, an external optical drive, an external magneto-optical drive, and/or the like. Other examples of secondary memory 620 may include semiconductor-based memory, such as programmable read-only memory (PROM), erasable programmable read-only memory (EPROM), electrically erasable read-only memory (EEPROM), and flash memory (block-oriented memory similar to EEPROM).

As mentioned above, system 600 may include a communication interface 640. Communication interface 640 allows software and data to be transferred between system 600 and external devices (e.g. printers), networks, or other information sources. For example, computer software or executable code may be transferred to system 600 from a network server via communication interface 640. Examples of communication interface 640 include a built-in network adapter, network interface card (NIC), Personal Computer Memory Card International Association (PCMCIA) network card, card bus network adapter, wireless network adapter, Universal Serial Bus (USB) network adapter, modem, a wireless data card, a communications port, an infrared interface, an IEEE 1394 fire-wire, and any other device capable of interfacing system 600 with a network or another computing device. Communication interface 640 preferably implements industry-promulgated protocol standards, such as Ethernet IEEE 802 standards, Fiber Channel, digital subscriber line (DSL), asynchronous digital subscriber line (ADSL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on, but may also implement customized or non-standard interface protocols as well.

Software and data transferred via communication interface 640 are generally in the form of electrical communication signals 655. These signals 655 may be provided to communication interface 640 via a communication channel 650. In an embodiment, communication channel 650 may be a wired or wireless network, or any variety of other communication links. Communication channel 650 carries signals 655 and can be implemented using a variety of wired or wireless communication means including wire or cable, fiber optics, conventional phone line, cellular phone link, wireless data communication link, radio frequency ("RF") link, or infrared link, just to name a few.

Computer-executable code (e.g., computer programs, such as the disclosed application, or software modules) is stored in main memory 615 and/or secondary memory 620. Computer programs can also be received via communication interface 640 and stored in main memory 615 and/or secondary memory 620. Such computer programs, when executed, enable system 600 to perform the various functions of the disclosed embodiments as described elsewhere herein.

In this description, the term "computer-readable medium" is used to refer to any non-transitory computer-readable storage media used to provide computer-executable code and/or other data to or within system 600. Examples of such media include main memory 615, secondary memory 620 (including internal memory 625, removable medium 630, and external storage medium 645), and any peripheral device communicatively coupled with communication interface 640 (including a network information server or other network device). These non-transitory computer-readable media are means for providing executable code, programming instructions, software, and/or other data to system 600.

In an embodiment that is implemented using software, the software may be stored on a computer-readable medium and loaded into system 600 by way of removable medium 630, I/O interface 635, or communication interface 640. In such an embodiment, the software is loaded into system 600 in the form of electrical communication signals 655. The software, when executed by processor 610, preferably causes processor 610 to perform one or more of the processes and functions described elsewhere herein.

In an embodiment, I/O interface 635 provides an interface between one or more components of system 600 and one or more input and/or output devices. Example input devices include, without limitation, sensors, keyboards, touch screens or other touch-sensitive devices, biometric sensing devices, computer mice, trackballs, pen-based pointing devices, and/or the like. Examples of output devices include, without limitation, other processing devices, cathode ray tubes (CRTs), plasma displays, light-emitting diode (LED) displays, liquid crystal displays (LCDs), printers, vacuum fluorescent displays (VFDs), surface-conduction electron-emitter displays (SEDs), field emission displays (FEDs), and/or the like. In some cases, an input and output device may be combined, such as in the case of a touch panel display (e.g., in a smartphone, tablet, or other mobile device).

System 600 may also include one or more optional wireless communication components that facilitate wireless communication over a voice network and/or a data network. The wireless communication components comprise an antenna system 670, a radio system 665, and a baseband system 660. In system 600, radio frequency (RF) signals are transmitted and received over the air by antenna system 670 under the management of radio system 665.

In an embodiment, antenna system 670 may comprise one or more antennae and one or more multiplexors (not shown) that perform a switching function to provide antenna system 670 with transmit and receive signal paths. In the receive path, received RF signals can be coupled from a multiplexor to a low noise amplifier (not shown) that amplifies the received RF signal and sends the amplified signal to radio system 665.

In an alternative embodiment, radio system 665 may comprise one or more radios that are configured to communicate over various frequencies. In an embodiment, radio system 665 may combine a demodulator (not shown) and modulator (not shown) in one integrated circuit (IC). The demodulator and modulator can also be separate components. In the incoming path, the demodulator strips away the RF carrier signal leaving a baseband receive audio signal, which is sent from radio system 665 to baseband system 660.

If the received signal contains audio information, then baseband system 660 decodes the signal and converts it to an analog signal. Then the signal is amplified and sent to a speaker. Baseband system 660 also receives analog audio signals from a microphone. These analog audio signals are converted to digital signals and encoded by baseband system 660. Baseband system 660 also encodes the digital signals for transmission and generates a baseband transmit audio signal that is routed to the modulator portion of radio system 665. The modulator mixes the baseband transmit audio signal with an RF carrier signal, generating an RF transmit signal that is routed to antenna system 670 and may pass through a power amplifier (not shown). The power amplifier amplifies the RF transmit signal and routes it to antenna system 670, where the signal is switched to the antenna port for transmission.

Baseband system 660 is also communicatively coupled with processor 610, which may be a central processing unit (CPU). Processor 610 has access to data storage areas 615 and 620. Processor 610 is preferably configured to execute instructions (i.e., computer programs, such as the disclosed application, or software modules) that can be stored in main memory 615 or secondary memory 620. Computer programs can also be received from baseband processor 660 and stored in main memory 610 or in secondary memory 620, or executed upon receipt. Such computer programs, when executed, enable system 600 to perform the various functions of the disclosed embodiments.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the automated string feeder includes at least one hardware processor, and one or more software modules that, when executed by the at least one hardware processor, detects the presence of the string and advances the string into the weave assembly as long as the presence of the string is detected.

2. The automatic string weaving system of claim 1, wherein the automated string feeder assembly is configured to automatically and rapidly weave string of various diameter, stiffness, and material properties through the weave assembly.

3. The automatic string weaving system of claim 1, wherein the automated string feeder includes a motor to impart motion to advance the string into the weave assembly.

4. The automatic string weaving system of claim 3, wherein the automated string feeder includes a motorized feeder wheel that directly engages the string to advance the string into the weave assembly.

5. The automatic string weaving system of claim 4, wherein the motorized feeder wheel includes a traction surface to facilitate engagement of the string to advance the string into the weave assembly.

6. The automatic string weaving system of claim 1, wherein the automated string feeder includes a clamp that clamps onto the string and advances the string into the weave assembly.

7. The automatic string weaving system of claim 1, wherein the weave assembly is a two-piece weave assembly including a top member and a bottom member with harmonious weaving geometry including mains and crosses to weave both the string rows and string columns, while also allowing for separation of the top member from the bottom member to allow operator access to the strings.

8. The automatic string weaving system of claim 1, further including a stand assembly.

9. The automatic string weaving system of claim 8, wherein the stand assembly includes a telescoping stand.

10. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the automated string feeder assembly is a smart automated string feeder assembly including a photo interrupter that reports state detection of the string, an encoder that reports at least one of position and speed of the string, a current measuring device that reports torque of the string, and a tensioner that accommodates a variety of string diameters.

11. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the automated string feeder includes at least one hardware processor, and one or more software modules that, when executed by the at least one hardware processor, assimilates sensory information from the automated string feeder assembly, and uses this sensory information to control speed, position, and acceleration of the string in order to protect against string damage due to obstruction, and provide a better user experience.

12. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the weave assembly includes a string receiving geometry configured to provide both mains strings and cross strings to be woven so that neither all of the mains strings nor all of the cross strings are in the same plane, reducing amplitude of woven mains strings and cross strings and reducing force required to push strings through the string receiving geometry of the weave assembly.

13. The automatic string weaving system of claim 12, wherein the automated string feeder assembly is configured to detect a presence of a string and advance the string into the weave assembly as long as the presence of the string is detected.

14. The automatic string weaving system of claim 13, wherein the automated string feeder includes a detector to detect the presence of the string.

15. The automatic string weaving system of claim 14, wherein the detector is a photo interrupter.

16. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the weave assembly is a two-piece weave assembly including a top member and a bottom member with harmonious weaving geometry including mains and crosses to weave both the string rows and string columns, while also allowing for separation of the top member from the bottom member to allow operator access to the strings, the top member includes a top subassembly with user controls, a middle subassembly with a printed circuit board, and a bottom subassembly with weave geometry.

17. The automatic string weaving system of claim 16, wherein the user controls allow the operator to operate manual feed, stop, and reverse operations.

18. An automatic string weaving system for weaving strings for a stringed sports racquet, comprising:

a weave assembly that the strings for the stringed sports racquet are weaved through; and an automated string feeder assembly to automatically weave the strings for the stringed sports racquet through the weave assembly, wherein the weave assembly includes longitudinal and latitudinal channels that the strings are weaved through, and the longitudinal and latitudinal channels each include at least one of a SINE and COSINE TRAPEZOIDAL wave, which when combined, produces an interlocking weave, thereby reducing required torque and friction required to move the string through the longitudinal and latitudinal channels.

19. The automatic string weaving system of claim 18, wherein the longitudinal and the latitudinal channels are configured to produce interlocking weave that has a string weave amplitude that is 2×(string height/2).

* * * * *